United States Patent [19]

Löfgren et al.

[11] Patent Number: 4,685,494

[45] Date of Patent: Aug. 11, 1987

[54] FILLING DEVICE

[75] Inventors: Peter Löfgren, Hovås; Nils Årthun, Partille, both of Sweden

[73] Assignee: Steridose Systems AB, Sweden

[21] Appl. No.: 622,129

[22] Filed: Jun. 19, 1984

[30] Foreign Application Priority Data

Jun. 27, 1983 [SE] Sweden ..... 8303656

[51] Int. Cl.[4] ..... B67D 5/00

[52] U.S. Cl. ..... 141/65; 222/310; 222/373

[58] Field of Search ..... 141/65, 67; 222/310, 222/335, 373; 417/384, 390, 386, 394; 92/13.2

[56] References Cited

U.S. PATENT DOCUMENTS

| | | | |
|---|---|---|---|
| 1,183,486 | 5/1916 | Pardue | 92/13.2 |
| 1,939,611 | 12/1933 | Purvis | 222/310 |
| 2,529,028 | 11/1950 | Landon | 222/373 |
| 3,194,164 | 7/1965 | Fink et al. | 92/13.2 X |
| 3,526,223 | 9/1970 | Curtis | 417/394 X |
| 4,195,668 | 4/1980 | Lewis | 138/30 |
| 4,335,835 | 6/1982 | Beigler et al. | 222/335 X |
| 4,386,634 | 6/1983 | Stasz et al. | 141/67 X |
| 4,409,977 | 10/1983 | Bisera et al. | 417/394 X |
| 4,474,540 | 10/1984 | Bonastia et al. | 417/394 X |

FOREIGN PATENT DOCUMENTS

| | | | |
|---|---|---|---|
| 1177065 | 4/1959 | France | 92/13.2 |

*Primary Examiner*—Stephen Marcus
*Assistant Examiner*—Mark Thronson
*Attorney, Agent, or Firm*—Wegner & Bretschneider

[57] ABSTRACT

A filling device for sterile filling of containers. A flexible temporary storage container is placed in a dosage chamber and exposed to external over-pressure and under-pressure, respectively. The filling goods is sucked into the temporary storage container and pressed out to the final storage container. A device for fine adjustment of the volume of the chamber has the shape of an adjustable membrane. The temporary storage container can be made of two semi-spheres, of which one is rigid and the other flexible. The flexible part forms a membrane having an area equal to the inner area of the rigid semi-sphere. In order to promote natural rolling of the membrane on the inner surface of the rigid semi-sphere, the membrane has reduced wall thickness in a direction towards the margin thereof.

9 Claims, 9 Drawing Figures

FILLING DEVICE

FIELD OF THE INVENTION

The present invention relates to filling devices, more precisely to filling devices for flexible containers, for instances pouches of plastic, plastic laminate or laminate of plastice and metal, primarily for liquid filling goods.

BACKGROUND OF THE INVENTION

The problem behind the invention is to realize provisions for using simple machinery for filling during given, rigorous conditions, especially sterile filling, aseptic filling or other high hygienic type of filling. The apparatus should also allow an exact dosage of the contents to the container. Aseptic and sterile filling should be accomplished such that the medium will not contact anything but the pouch. It should for instance not contact stainless steel.

A number of versions of machinery are known, but they all comprise complex and cumbersome equipment, especially as far as conditions of hygiene are concerned.

The object of the invention is to offer a new thinking within the area and eliminate the disadvantages of the prior art.

SUMMARY OF THE INVENTION

The invention provides a device for filling of containers, comprising a dosage chamber for receiving filling goods, an inlet and an outlet to and from, respectively, said dosage chamber, means for supplying and discharging, respectively, of filling goods to and from said dosage chamber, a temporary storage container, at least partly flexible, placeable in the chamber and operatively connectable to the inlet and outlet, and members establishing a predetermined pressure condition inside the chamber.

In a preferred embodiment the pressure establishing members comprise sources, preferably for pressurized air and vacuum, respectively, for under-pressure and over-pressure, and said sources are arranged for communication with the internal region of the chamber through openings in the chamber walls.

In order to arrange for the proper operation sequence the inlet preferably has a first valve device, and the outlet is provided with a second valve device, and the closing and opening functions of the valve devices are synchronized relative to the connection of the source of under-pressure and over-pressure, respectively, to the openings such that an under-pressure is established in the flexible container when the under-pressure source expands the flexible container.

The outlet is arranged to be connected to said container finally receiving the contents, and in the outlet conduit there is arranged a vacuum device for removing air before the contents are transferred from the flexible container to said container.

The transfer of the contents takes place by use of the over-pressure source.

In a specific preferred embodiment the said container is of the same type and identical to the flexible container.

The chamber preferably is formed in one-half of two generally identical halves forming an openable housing.

An adjustable membrane for exact setting of the filling volume preferably forms a part of the housing and forms at least a portion of a chamber wall.

In another embodiment the container comprises a pair of container parts of which at least one, with maintained internal environment, is placeable to abutment with the inside of the second container part.

The second container part preferably is formed as a rigid semi-sphere.

In this case the first container part is formed as a membrane attached to the margin of the semi-spheric container part.

The membrane has an area essentially equal to the inner area of the rigid semi-sphere.

In an advantageous embodiment the membrane is thinner at the edge region than at the central region.

In a specific embodiment the chamber is provided with a circumferential fine adjustment device arranged for abutment against the said one container part, at least along substantially the entire transit region between the two container parts.

In a further embodiment the chamber is arranged for receiving volume determining inserts in the part thereof where the first container part is to be placed.

Each insert preferably has a portion thereof for abutment against the membrane and of a form corresponding to the natural rolling condition at the actual volume.

DESCRIPTION OF PREFERRED EMBODIMENTS

Figure 1:
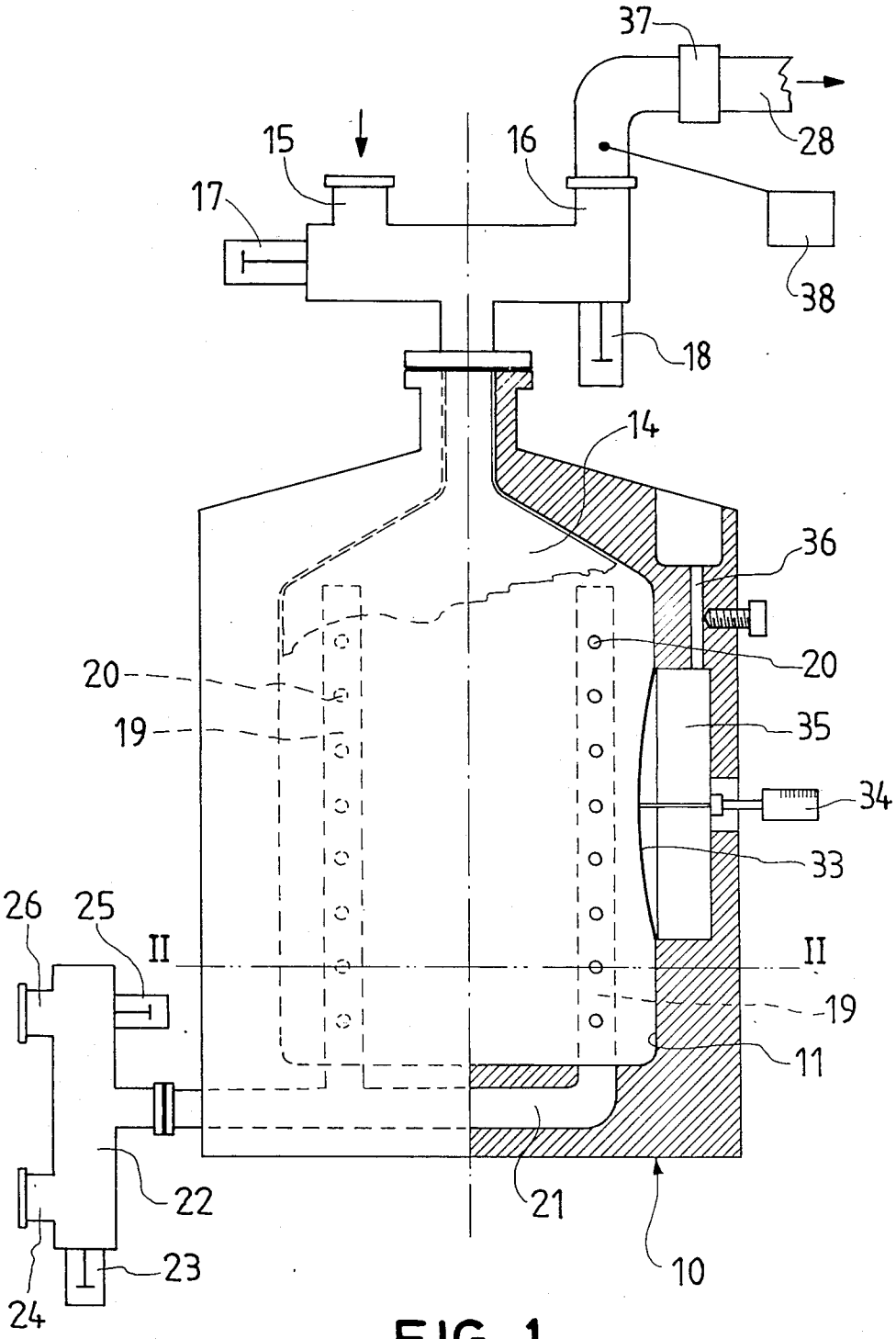
FIG. 1 partly in a section view shows a dosage device and the auxiliary equipment thereof.
Figure 2:
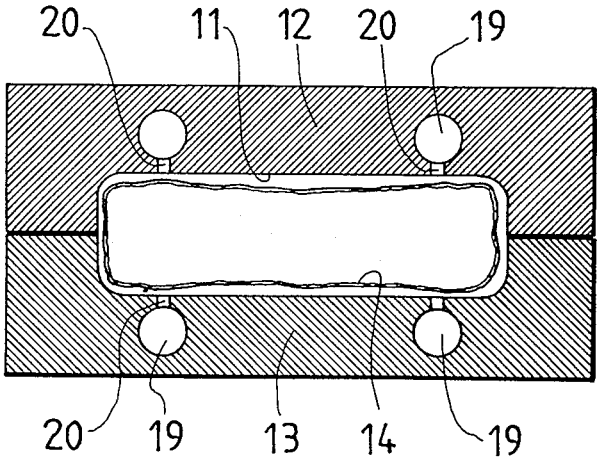
FIG. 2 is a section along line II—II in FIG. 1.

In the dosage device 10 in FIG. 1 there is formed a dosage chamber 11 having a section as shown in FIG. 2. The chamber is formed by two halves 12 and 13 forming a housing. Said halves are separable by simple manual operations for placing a flexible, temporary storage container 14 inside the chamber. Means (not shown) are also arranged for connecting an opening of the container 14 to the inlet 15 and outlet 16, respectively, to/from the chamber 11. The connection is such that the flexible container communicates with the inlet and the outlet, respectively, without leakage. Such communication is controlled in a predetermined sequence by closable and openable solenoid valves 17, 18.

In the position in FIG. 2 the housing halves 12, 13 form a dosage chamber 11 essentially fully sealed from the environment. The chamber walls have channels 19 formed therein and said channels communicate with the chamber 11 via a number of openings 20. The channels 19 communicate with a manifold conduit 21 leading to a valve controlled connection piece 22. Under the control of a solenoid valve 23 the connection line 24 to a source for under-pressure (vacuum source) is closed/opened, and under the control of a solenoid valve 25 the connection 26 to a source for over-pressure (pressurized air) is closed/opened.

Figure 3:
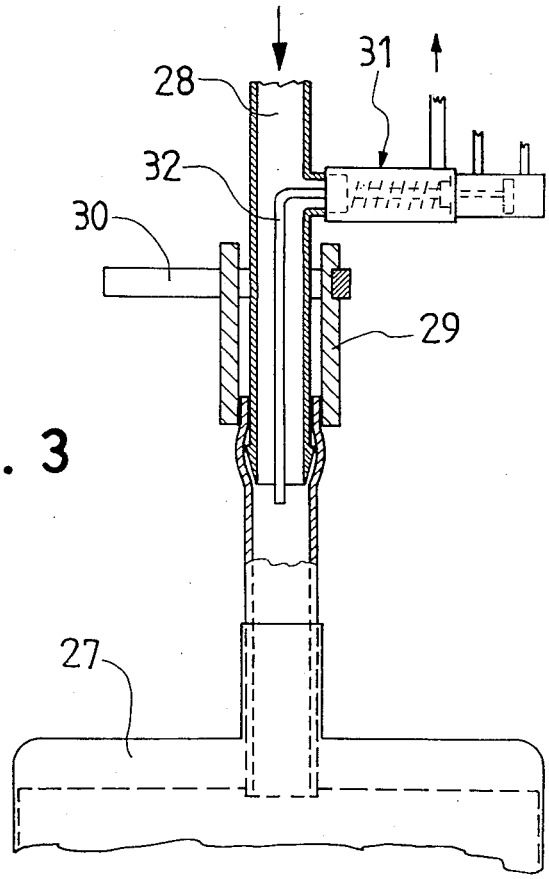
FIG. 3 is a schematic view of the filling goods receiving container and the connection pieces thereof.
Figure 4:
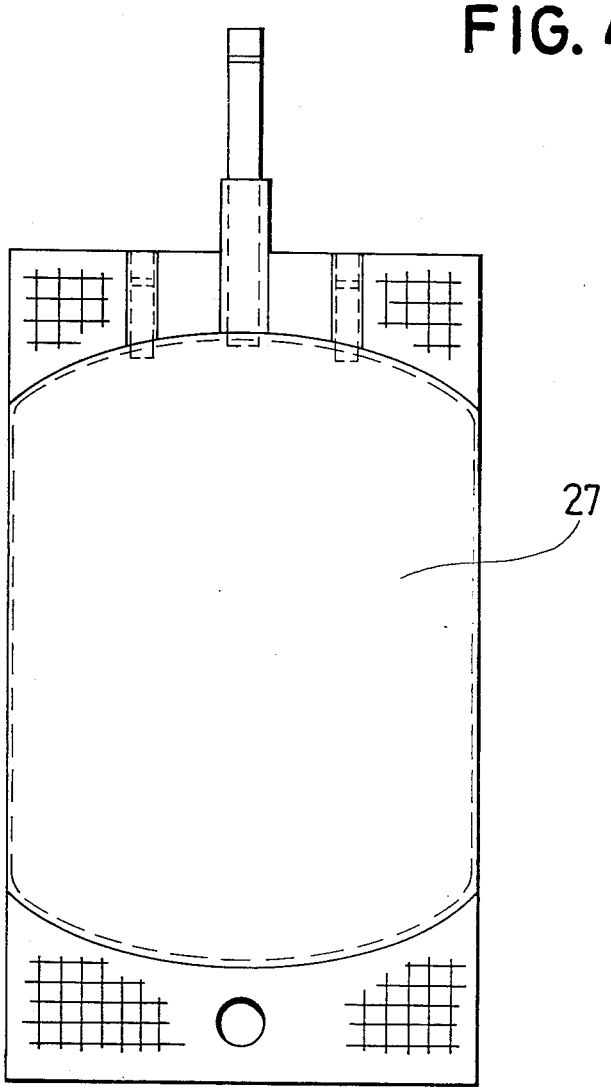
FIG. 4 shows the filling goods receiving container which may be of the same type and identical to the flexible container of the dosage device, FIG. 5 in cross-section shows a further embodiment of a container which in this case is partly flexible, the form of the container being shown in the starting position and during filling (by broken lines), respectively.

In FIG. 3 there is shown a filling goods receiving container (pouch) 27 attached to a conduit 28 from the outlet 16 in FIG. 1. The pouch, which may be of the type shown in FIG. 4, is tightly mountable in communication with the conduit 28 by means of a pressure sleeve 29 preferably having a groove in which a fork 30 supporting the pouch is accomodated.

A vacuum valve 31 and a thin pipe 32 connected thereto provides for the necessary evacuation of air in the conduit 28 before the filling goods in transferred to the pouch 27, which preferably is a sterile pouch and where the sterile conditions are not allowed to be distrubed when the conduit 28 is brought into communciation with the pouch.

In the sectioned part of FIG. 1 there is shown an adjustable membrane 33 for fine adjustment of the volume defined by the chamber 11. In the embodiment shown the adjustment is obtained by a micro-meter screw arrangement 34. The chamber 35 inside the membrane may be pressurized via a conduit 36.

The chamber volume, fine adjusted by the membrane 33, determines the filling volume of the flexible temporary storage container 14 and therefore also the filling volume of the pouch 27. Container 14 and pouch 27 are preferably of the same type and identical.

The function of the arrangement is basically the following. The container 14 expands against the walls of the chamber 11 and membrane 33 due to the pressure difference that the under-pressure conduit 24 provides via the conduit 21, the channels 19 and the openings 20. The valve 18 is closed and so is of course also the valve 25. The valve 17 is open, and the under-pressure created inside the container 14 implies that the filling goods from a storage (not shown) is sucked into the container via the inlet 15. Normally the filling goods is in a liquid phase and flows undisturbed into the container until the intended volume is obtained.

Hereafter the valve 17 is closed. The valve 18 is now open and the conduit 21, the channels 19 and the openings 20 communicate with the high pressure conduit 26, and the filling goods is pushed out through the outlet 16. The outlet is connected to the conduit 28 leading to the pouch 27. The conduit 28 has been evacuated before the filling goods arrives. Thus, the interior of the pouch 27 is not contaminated by air.

Due to the fact that the system initially is run through some operation sequences before starting the filling in sterile pouches, it is guaranteed that the system is conditioned such that it meets high hygiene standards. The lack of plungers and similar mechanical arrangements allows the maintenance of a sterile environment without any difficult cleaning operation.

In FIG. 1 there is a filter 37 placed between the dosage chamber 11 and the pouch 27 on the pressure side.

Between the filter and a first chamber there may be arranged an electronic bubble point meter 38. The bubble point pressure may be monitored digitally and so may also the filling pressure and the top pressure (peak) of each filling stroke.

A printer is preferably connected to the equipment and provides the actual values of the bubble point, peak pressure and filling stroke number in hard copy form.

The bubble point is measured by useing the flexible, temporary storage container without any need for supplying gas or other medium from the outside.

Figure 5:
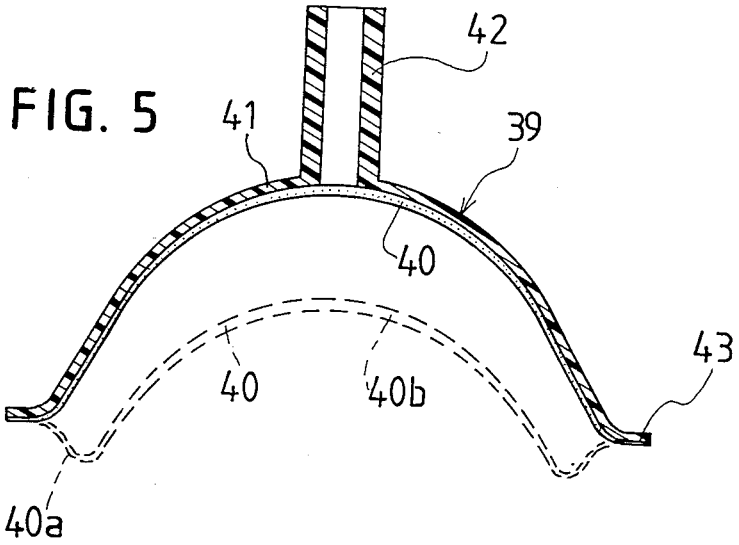

In FIG. 5 there is shown a further embodiment of a flexible container. The container 39 comprises a first flexible container part or membrane 40 and a second container part 41 substantially formed as a rigid semi-sphere. The container parts preferably are manufactured separately and thereafter sealed together along the edge region to form a tight sealing flange 43.

The support part 41 preferably is made semi-spheric and formed with an attachment neck 42. The wall thickness of the support part is made uniform.

The membrane 40, however, ahs varying wall thickness, such that the thickness of the edge region **40*a* thereof is smaller than the thickness of the central portion 40*b***. Further on, the area of the membrane is such that it generally is equal to the inner area of the support part of the semi-sphere.

In the starting position the membrane 40 abuts the support part. When the filling of the container 39 proceeds, the membrane 40 is rolled up and at each moment it assumes its "natural" rolling up condition, primarily determined by the actual wall thickness variation. By broken lines 40 there is shown such a condition during filling.

Figure 6:
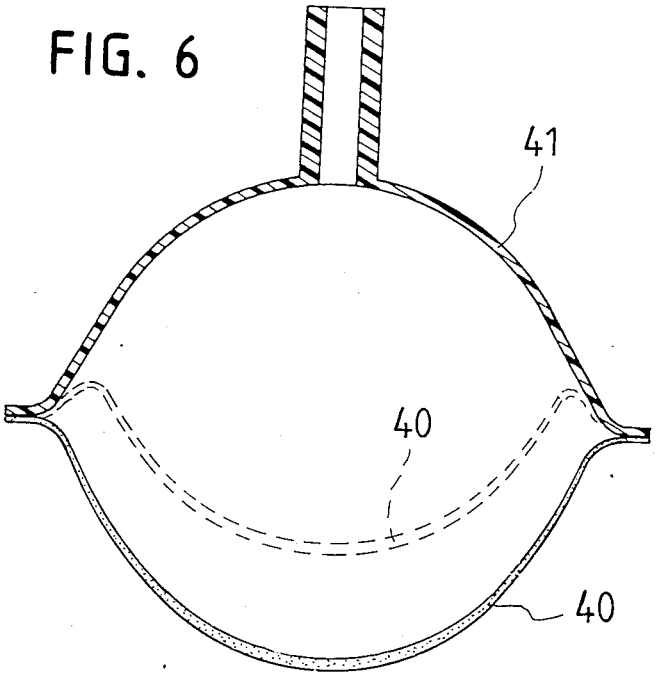
FIG. 6 shows the container of FIG. 5 in a filled condition and during discharging (by broken lines)

In FIG. 6 there is shown by solid lines the condition of the membrane 40 when the container is completely filled. By broken lines there is shown the condition of the membrane during discharging. Also in this particular case a "normal" rolling up condition (or rolling in) condition is assumed and determined by the wall thickness variation.

Figure 7:
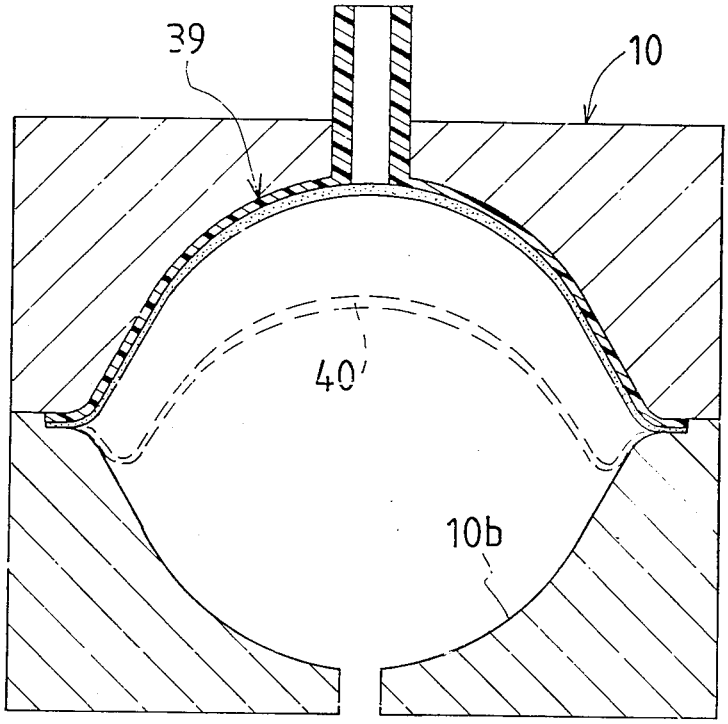
FIG. 7 shows the container of FIG. 5 in a filling device which is shown partly schematically.

In FIG. 7 there is shown how the container 39 is placed in the dosage device 10. Two halves of this device define substantially equal internal hollow chambers **10*a* and 10*b*. The latter one supports the natural rolling up (rolling in) of the membrane 40**.

Figure 8:
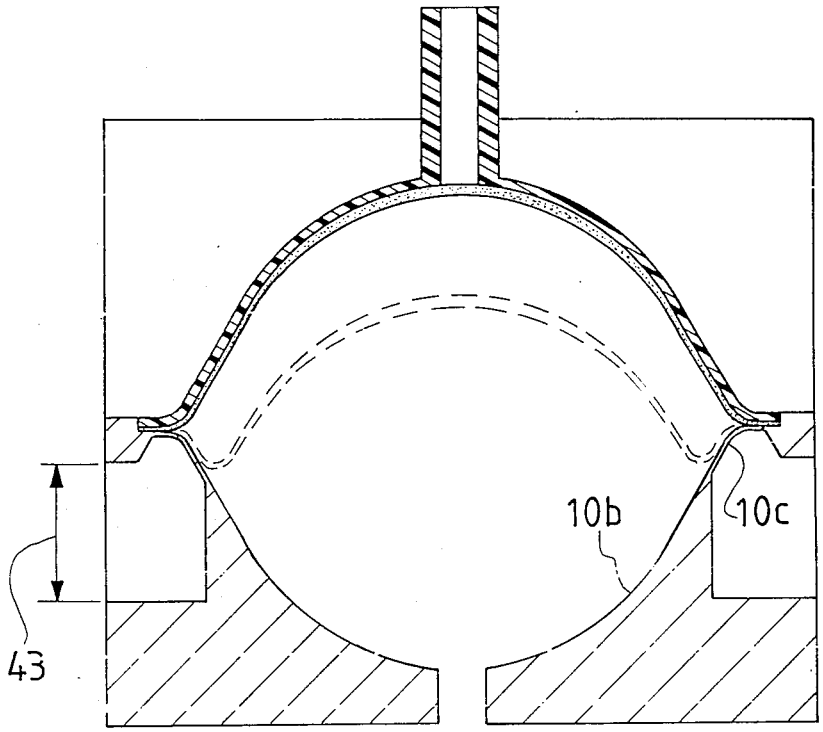
FIG. 8 shows the filling device of FIG. 7 and a volume fine adjustment device.

In FIG. 8 there is shown a possibility of using the lower form half **10*b* for fine adjustment. The upper wall part 10*c* thereof is thin and formed as a flexible, peripherally circumferential abutment element 10*c*. This element is displaceable essentially by rolling corresponding to the natural rolling of the membrane by vertically displacing the part 10*b* in the direction of the arrow 43**.

Figure 9:
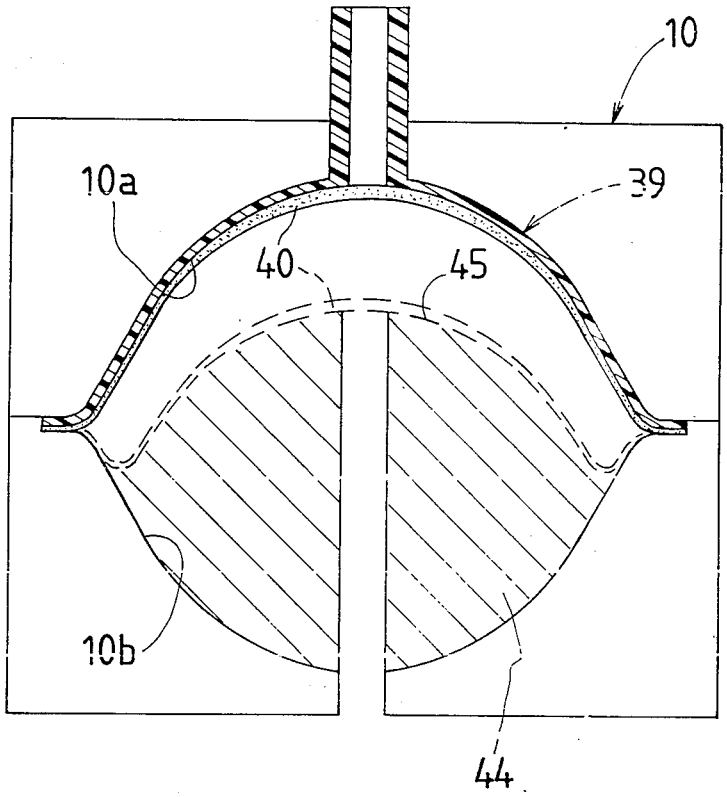
FIG. 9 shows the filling device of FIG. 7 provided with a volume defining insert.

FIG. 9 shows a method of adjusting the dosage to other than the maximum volume when using one and a same container 39. in this case there is a volume determining insert 44 placed inside the hollow chamber 10. The surface 45 of this insert intended to abut the membrane 40 has a shape corresponding to the natural rolling up/rolling in form of the membrane at the actual volume.

By using such volume determining inserts a broad volume range may be covered by one and a same dosage device 10 and container 39.

We claim:

1. A device for filling a container comprising:

(A) a housing defining a dosage chamber therein;

(B) an at least partly flexible temporary storage container disposed in said chamber, said temporary storage container being of a size that it can fully line the walls of said chamber;

(C) inlet means for supplying filling goods to said temporary storage container, outlet means for emptying said filling goods from said temporary storage container, and means communicating said inlet and outlet means with the interior of said temporary storage container without leakage;

(D) means for establishing a predetermined pressure condition inside said chamber comprising channels disposed within the walls of said housing, openings communicating said channels with said chamber, and means for selectively applying one of vacuum from a vacuum source and pressure from a pressure source to said channels; and (E) adjustable means to regulate the volume of said chamber, said regulating means comprising a second chamber disposed in the wall of said housing and separated from said dosage chamber by a membrane, means to apply pressure to said second chamber to cause said membrane to distend into said dosage chamber, and mechanical fine-adjustment means for causing said membrane to distend into said dosage chamber.

2. A device for filling a container comprising;

(A) a housing defining a dosage chamber therein;

(B) an at least partly flexible temporary storage container disposed in said chamber, said temporary storage container being of a size that it can fully line the walls of said chamber;

(C) inlet means for supplying filling goods to said temporary storage container, outlet means for emptying said filling goods from said temporary storage container, and means communicating said inlet and outlet means with the interior of said temporary storage container without leakage; and (D) means for establishing a predetermined pressure condition inside said chamber comprising channels disposed within the walls of said housing, a plurality of openings communicating said channels with said chamber, and means for selectively applying one of vacuum from a vacuum source and pressure from a pressure source to said channels, whereby said plurality of openings serves to selectively communicate vacuum or pressure to said chamber.

(E) said inlet means including a first valve means, said outlet means including a second valve means, and the closing and opening functions of the valve means being synchronized relative to the communication of the vacuum source and the pressure source, respectively, with the channels such that a vacuum is obtained in the temporary storage container when the vacuum source expands the same;

(F) said outlet means comprising a conduit arranged for being connected to said container to be filled, and means for applying a vacuum in said outlet conduit for removing air before the filling goods are transferred from the temporary storage container to said container to be filled.

3. A device as in claim 2, wherein said means for establishing a predetermined pressure condition inside said chamber further comprises third valve means between said pressure source and said channels, whereby when said third valve means is activated to apply pressure to said channels, the pressure is transmitted to said temporary storage container to force said goods out to said outlet means and, thence, to said container to be filled.

4. A device as in claim 3, wherein said container to be filled is of the same type and identical to said temporary storage container.

5. A device for filling a container comprising:

(A) a housing defining a dosage chamber therein;

(B) an at least partly flexible temporary storage container disposed in said chamber, said temporary storage container normally being of a size that it can fully line all of the walls of said chamber;

(C) inlet means for supplying filling goods to said temporary storage container, outlet means for emptying said filling goods from said temporary storage container, and means communicating said inlet and outlet means with the interior of said temporary storage container without leakage; and (D) means for establishing a predetermined pressure condition inside said chamber comprising channels disposed within the walls of said housing, said channels being disposed at least in part in a direction that is not transverse to the thickness of the walls, a plurality of openings communicating said channels with said chamber, and means for selectively applying one of vacuum from a vacuum source and pressure from a pressure source to said channels, whereby said plurality of openings serves to selectively communicate vacuum or pressure to said chamber.

6. A device as in claim 5, wherein the inlet means includes a first valve means, the outlet means includes a second valve means, and the closing and opening functions of the valve means are synchronized relative to the communication of the vacuum source and the pressure source, respectively, with the channels such that a vacuum is obtained in the temporary storage container when the vacuum source expands the same.

7. A device as in claim 5, wherein said housing and chamber are formed by two substantially identical housing halves which are separable for mounting and demounting of the temporary storage container.

8. A device as in claim 5, wherein the temporary storage container comprises a pair of container parts, of which at least one, with maintained internal environment, is placeable to abutment with the inside of the second container part.

9. A device as in claim 8, wherein said chamber is provided with circumferential fine adjustment means arranged for abutment against at least a part of said one container part.

* * * * *